US006364137B1

(12) United States Patent
Glauth et al.

(10) Patent No.: US 6,364,137 B1
(45) Date of Patent: Apr. 2, 2002

(54) PORTABLE MULTI-BRAND DISPLAY RACK

(75) Inventors: Ted W. Glauth, Arvada; Randall D. Guenther, Lakewood, both of CO (US)

(73) Assignee: Coors Brewing Company, Golden, CO (US)

( * ) Notice: Subject to any disclaimer, the term of this patent is extended or adjusted under 35 U.S.C. 154(b) by 0 days.

(21) Appl. No.: 09/643,475

(22) Filed: Aug. 22, 2000

(51) Int. Cl.[7] ..... A47B 43/00
(52) U.S. Cl. ..... 211/186; 211/126.9
(58) Field of Search ..... 211/186, 187, 211/189, 181.1, 134, 153, 126.1, 126.2, 126.9, 126.11, 126.14, 128.1, 133.2, 133.5; 280/79.11, 79.3, 47.26, 79.7; 108/25, 26, 59, 91, 92, 180, 181, 182

(56) References Cited

U.S. PATENT DOCUMENTS 1,381,607 A * 6/1921 Weston
D118,442 S * 1/1940 Brown
D122,462 S * 9/1940 Griffin
D123,432 S * 11/1940 Kneebone
2,315,595 A * 4/1943 Chappory
D167,395 S * 8/1952 Dunn
2,716,495 A * 8/1955 Prevette et al.
2,761,568 A * 9/1956 Temple
2,775,352 A * 12/1956 Waite
2,913,128 A * 11/1959 Milner
3,007,708 A * 11/1961 Ochs
3,149,727 A * 9/1964 Magers
3,272,345 A * 9/1966 Wallace
3,719,408 A * 3/1973 Fullington et al.
D229,383 S * 11/1973 Rollins
D237,337 S * 10/1975 Peets
4,015,885 A * 4/1977 Baggaley
4,313,544 A * 2/1982 Ashton ..... 211/181.1
4,819,899 A * 4/1989 Weil ..... 211/133
4,976,360 A * 12/1990 Zucker et al. ..... 211/186
4,978,013 A * 12/1990 Hogg ..... 211/132
D315,459 S * 3/1991 Young, III et al. ..... 211/189
5,215,199 A * 6/1993 Bejarano ..... 211/189
5,624,044 A * 4/1997 Black, Jr. ..... 211/186
5,797,503 A * 8/1998 Stevens et al. ..... 211/187
RE36,134 E * 3/1999 Stein ..... 211/133.1
6,029,833 A * 2/2000 Yeh ..... 211/189
6,062,402 A * 5/2000 Ford ..... 211/189
D435,743 S * 1/2001 Glauth et al. ..... D6/465

* cited by examiner

*Primary Examiner*—Jerry Redman
*Assistant Examiner*—Jennifer E. Novosad
(74) *Attorney, Agent, or Firm*—Klaas, Law, O'Meara & Malkin, P.C.; William P. O'Meara; Nellie C. Kaufman

(57) ABSTRACT

A portable display rack having a tubular steel frame, a plurality of shelves, and at least one pair of baskets removably attached to the left and right sides of the frame. The display rack has a left side display area and a right side display area which extend substantially from the basket on each side to almost the bottom of the frame. Each display area is adapted to retain a plurality of signs and to display one of the signs. Each of the signs may advertise a specific brand of a manufacturer's product. A first sign holder adapted to display a first upper sign is removably attached to the upper end of the frame. The display rack may further include a second sign holder removably attached to the first sign holder which is adapted to display a second upper sign therein. The display rack may further include shelf strips, lockable casters, and a kick-plate.

22 Claims, 8 Drawing Sheets

PORTABLE MULTI-BRAND DISPLAY RACK

FIELD OF THE INVENTION

The present invention relates generally to merchandise display racks, and more particularly to a portable display rack which is adapted to advertise and display a variety of food and beverage products.

BACKGROUND OF THE INVENTION

Merchandise display racks are used to store and attractively display a wide variety of products. A portable display rack may be provided with casters or the like in order to provide the flexibility to display merchandise anywhere in the store and to move the rack as necessary. Portable display racks which are provided by a manufacturer are usually adapted for use with a particular type and/or brand of merchandise. For example, a brewing company may use a rack which is adapted to hold a certain brand of beer. Such a rack typically includes shelves or the like for storing and displaying the merchandise and may also include non-removable advertising thereon which is directed to a specific brand of beer. Practically speaking, such a rack may not be used to sell any other brand of beer or other type of product such as, for example, food.

Accordingly, it is an object of the present invention to provide a portable display rack which provides the flexibility to display more than one brand of merchandise.

It is also an object of the present invention to provide a portable display rack which is adapted to concurrently display different types of merchandise, such as food and beverages.

It is a further object of the present invention to provide a portable display rack with shelves for displaying a primary product and baskets for displaying a cross-merchandising product.

It is a further object of the present invention to provide a portable display rack with display areas which are each adapted to retain a plurality of self-storing, interchangeable signs and to alternately display one of the signs therein.

It is a further object of the present invention to provide a portable display rack with removable sign holders.

It is a further object of the present invention to provide a portable display rack which presents advertising to a customer from both the left and right sides thereof, as well as the front and possibly also the back of the display rack.

These and other objects, features, and advantages of the invention shall be described below in the following Summary of the Invention and Detailed Description of the Invention.

SUMMARY OF THE INVENTION

The present invention is directed to a portable display rack having a frame which may be comprised of tubular steel posts. The frame has a substantially open front side, a rear side, a left side, a right side, a top side and a bottom side. The rack further comprises a plurality of shelves which may be adapted to display a manufacturer's primary product such as a beverage product. The rack also comprises at least one pair of baskets removably attached at the left and right sides of the frame which may be adapted to display a cross-merchandising product such as a food product.

Display areas are located on the left and right sides of the frame, under the baskets. Each of the display areas is adapted to retain a plurality of signs and to display one of the signs therein and may include a plurality of sign retaining members. The signs may advertise alternate brands of a manufacturer's primary product. The display rack may further comprise a first sign holder and a second sign holder adapted to display upper signs therein. These upper signs may advertise price and/or a manufacturer's primary product, although not necessarily any particular brand of product.

Each of the shelves on the display rack may have a shelf strip adapted to retain an elongate sign strip. The shelves and baskets may be of a conventional wire or plastic-coated wire construction. The first sign holder may also be of a tubular steel construction and may be removably mounted to the frame. The second sign holder may be of a wire construction and be removably mounted to the first sign holder. A plurality of lockable casters may provide the portability of the display rack. The display rack may also include a kick-plate.

BRIEF DESCRIPTION OF THE DRAWINGS

Illustrative and presently preferred embodiments of the invention are shown in the accompanying drawings in which.

DETAILED DESCRIPTION OF THE INVENTION

Figure 1:
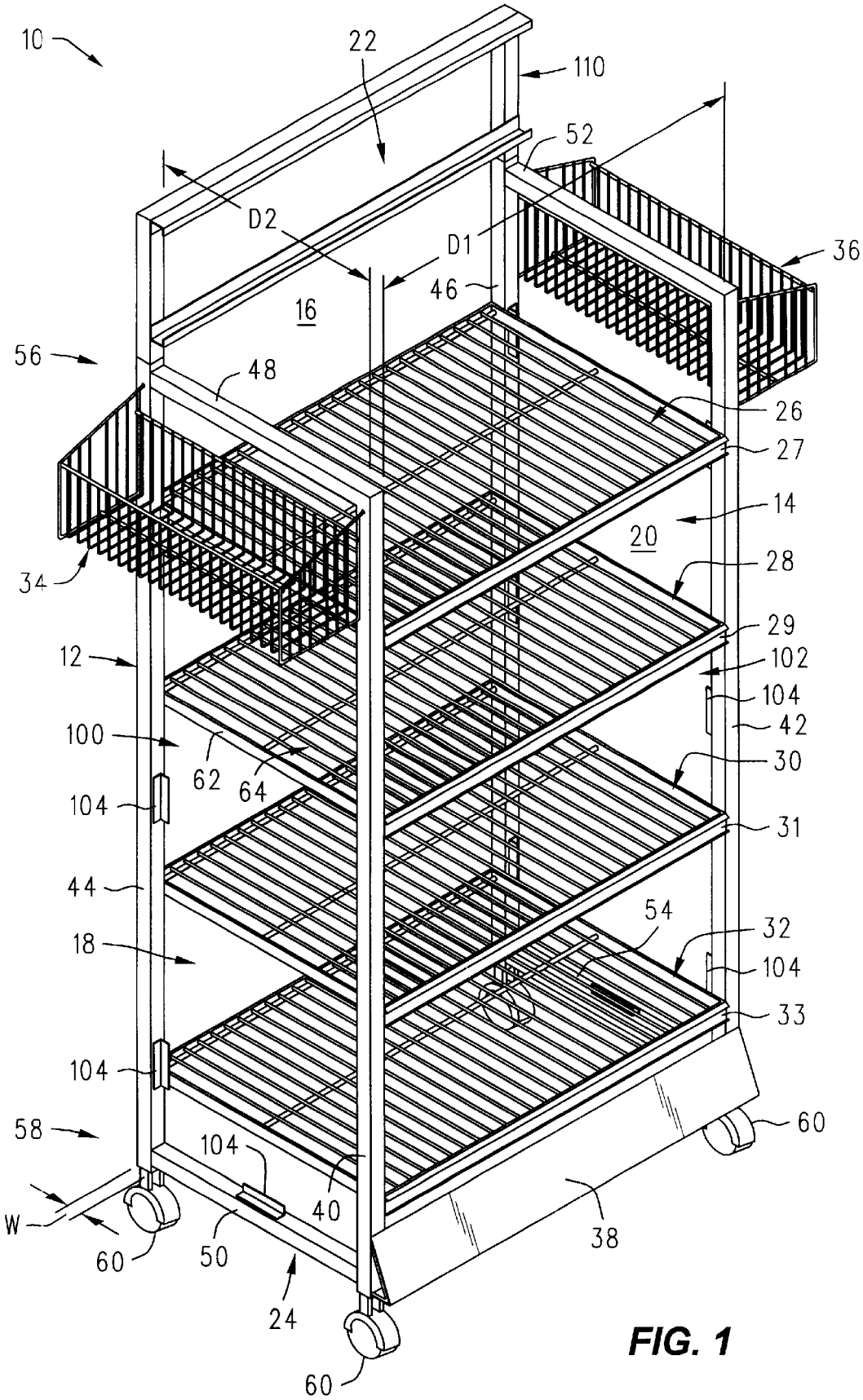
FIG. 1 is an isometric view of a first embodiment of the display rack of the present invention.

FIG. 1 illustrates a first embodiment of the display rack 10. The display rack 10 may comprise a frame 12 having a front side 14, a rear side 16, a left side 18, a right side 20, a top side 22, and a bottom side 24. The display rack 10 further comprises a plurality of shelves 26, 28, 30, 32 and at least one basket 34, 36 on each of the left side 18 and right side 20. The frame 12 may be comprised of a plurality of tubular steel posts 40, 42, 44, 46, 48, 50, 52, 54 which may each be square in cross-section and have a width "W" on each side of, for example, 1 inch wide. The posts 40, etc. may alternatively have a different cross-sectional shape such as round as long there is sufficient strength to support the shelves 26, 28, 30, 32, baskets 34, 36, and merchandise thereon. The rack 10 is preferably portable and may comprise a plurality of conventional and commercially available casters 60 which are preferably equipped with releasable locks or brakes (not shown) to selectively prevent rotation thereof. A kick-plate 38 may also be provided as shown in FIG. 1.

The front side 14 of the frame 12 may be comprised of a first post 40 and a second post 42 which are separated from one another by a distance "D1". The front side 14 is preferably substantially open so that the merchandise on the shelves 26, 28, 30, 32 is highly visible to customers. The rear side 16 of the frame 12 may be comprised of a third post 44 and a fourth post 46 which are preferably separated from one another by approximately the same distance "D1". The rear side 16 may also be substantially open as shown in FIG. 1, although it is not necessarily so. The left side 18 of the frame 12 may be comprised of the first post 40, the third post 44, a fifth post 48 at the upper end 56 of the frame 12, and a sixth post 50 at the lower end 58 of the frame 12. As shown in FIG. 1, the fifth post 48 may be attached to or integrally formed with the first post 40 so that the fifth post 48 and the first post 40 form an upside-down "L" shape. The right side 20 of the frame 12 may be comprised of the second post 42, the fourth post 46, a seventh post 52 at the upper end 56 of the frame 12, and an eighth post 54 at the lower end 58 of the frame. As noted above and shown in FIG. 1, a caster 60 preferably extends from each of the first, second, third and fourth posts 40, 42, 44, 46 at the lower end 58 of the frame 12.

Still referring to FIG. 1, each of the shelves 26, 28, 30, 32 may be either fixedly or removably attached to the first, second, third and fourth posts 40, 42, 44, 46. For example, each of the shelves 26, etc., may be welded to the posts 40, etc. Alternatively, shelf brackets (not shown) or the like may extend from each of the posts 40, 42, 44, 46 which are adapted to removably support the shelves 26, etc. As is known in the art, the shelf brackets or the like may be adjustably mounted on the posts 40, etc., e.g., each post may comprise a plurality of openings (not shown) adapted to receive brackets or the like. The shelves 26, etc. may be of a conventional wire or plastic coated wire construction and may each comprise a rim, e.g., 62, which preferably extends slightly higher than the center portion, e.g., 64, of the shelf in order to facilitate retaining merchandise on the shelf. Each of the shelves 26, 28, 30, 32 may also have a shelf strip 27, 29, 31, 33, respectively, fixedly attached thereto and extending substantially from the first post 40 to the second post 42. The shelf strips 27, etc. are each adapted to retain an elongate advertising or pricing sign strip (not shown) or the like. While four shelves 26, 28, 30, 32 are shown in each of the figures, it is to be understood that any number of shelves may be used on a display rack 10.

Figure 2:
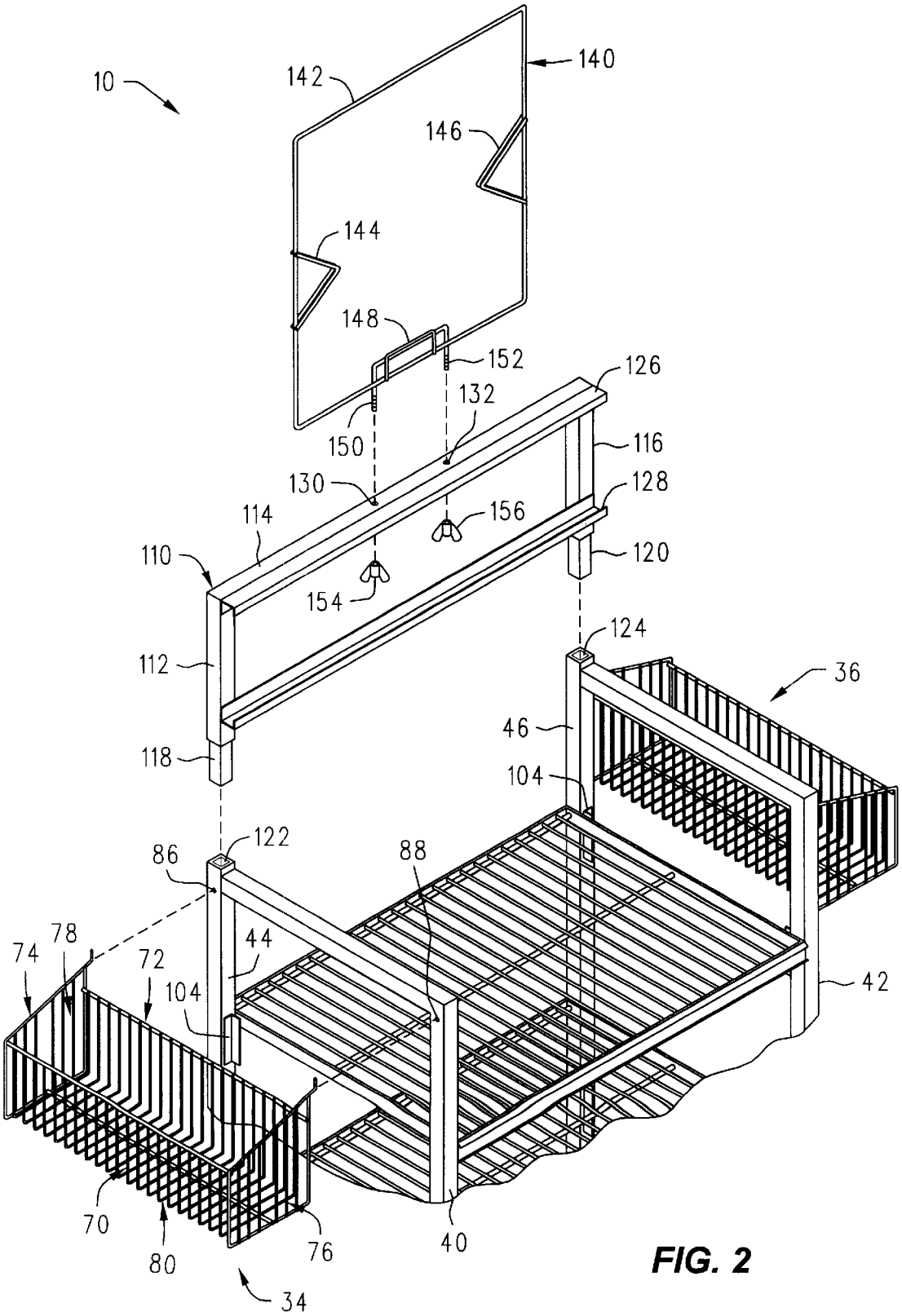
FIG. 2 is an exploded isometric view of the upper portion of the display rack of FIG. 1 includes an upper sign holder.
Figure 3:
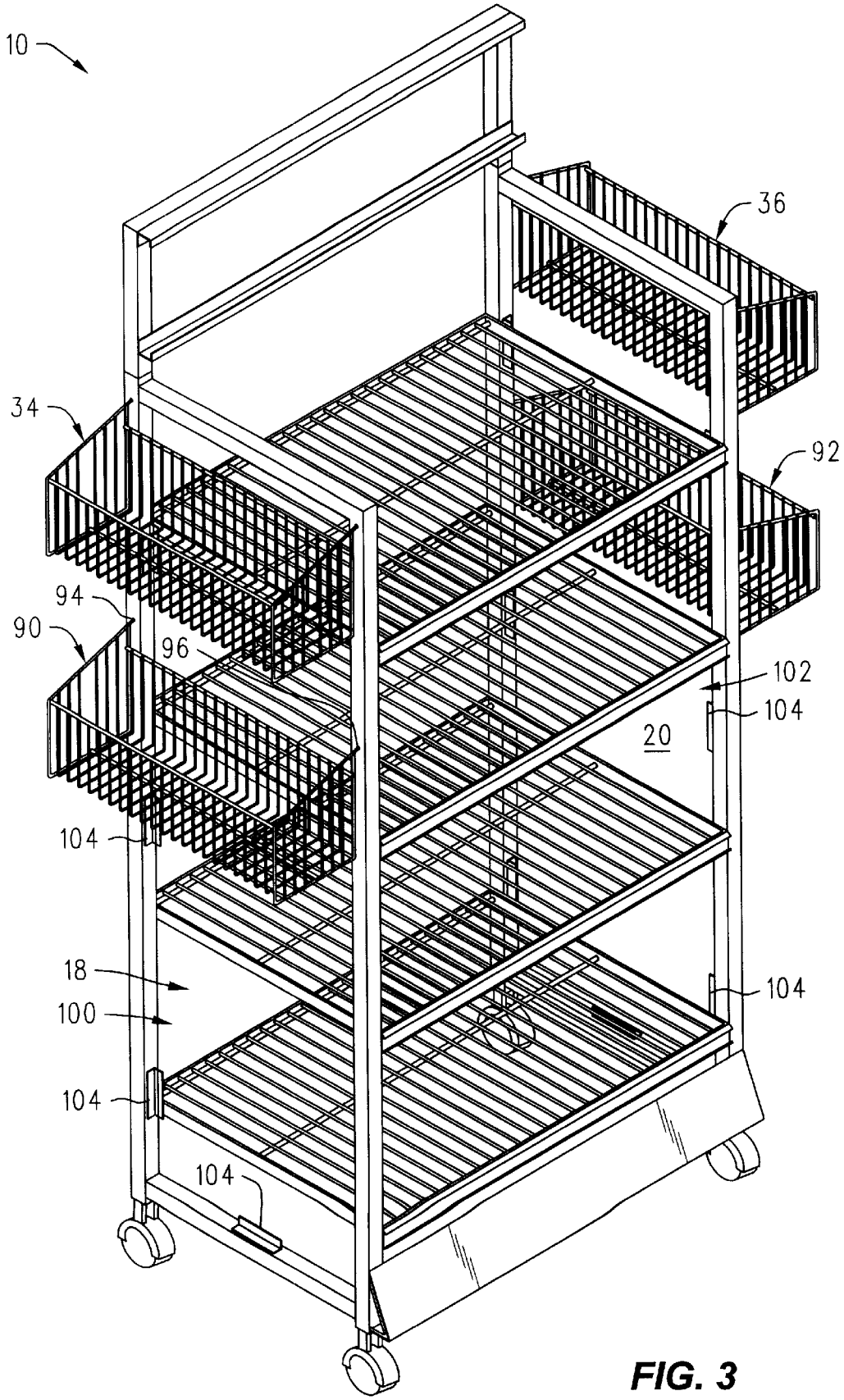
FIG. 3 is an isometric view of a second embodiment of the display rack of the present invention.

As shown in FIG. 1 and 2, one or more baskets 34, 36 may detachably hang on each of the left side 18 and right side 20. As shown in FIG. 2, the baskets, e.g., 34, may be of a conventional wire or plastic coated wire construction and may comprise a front side 70, a rear side 72, a left side 74, a right side 76, a substantially open top side 78, and a bottom side 80. Each of the baskets, e.g., 34, may comprise substantially vertically extending portions 82, 84 on the intersection of the rear and top sides 72, 78 thereof. The extending portions are adapted to be inserted into openings 86, 88 in the posts (e.g. third post 44 and first post 40). The openings 86, 88 may be holes as shown, slots, or the like. The display rack 10 may be symmetrical, i.e., the left and right sides 18, 20 may be mirror images of one another, so that customers may shop both sides 18, 20. In other words, a basket 34, 36 may hang from each of the left and right sides 18, 20 of the rack 10. Another embodiment of the rack 10 is shown in FIG. 3 wherein two baskets 34, 90 and 36, 92 hang from each of the left and right sides 18, 20 of the rack 10. In this embodiment, an extra set of openings, e.g., 94, 96 (which may be substantially identical to openings 86, 88) are provided on each of the sides 18, 20 to support the additional baskets 90, 92. Since the baskets 34, 36, 90, 92 are removable, each retailer may arrange and rearrange the baskets as desired.

As shown in FIGS. 1 and 3, a display area 100, 102 is located on each of the left and right sides 18, 20, respectively, of the rack 10. The left side display area 100 is located below the basket 34 (or the basket 90 in the FIG. 3 embodiment) and between the first post 40, the third post 44, and the sixth post 50. The right side display area 102 is located below the basket 36 (or the basket 92 in the FIG. 3 embodiment) and between the second post 42, the fourth post 46, and the eighth post 54. A plurality of sign retaining members 104 fixedly attached to the frame 12 may be adapted to retain a plurality of signs and to display one of the signs, as described in further detail below with reference to FIGS. 4 and 7–8.

As shown in FIGS. 1 and 2, the rack 10 may further comprise a first (upper) sign holder 110 which may be removably attached to the third and fourth posts 44, 46. Specifically, as shown in FIG. 2, the first sign holder 110 may be constructed of steel posts 112, 114, 116 which may be integrally formed. Two of the steel posts 112, 116 may comprise extending portions 118, 120, respectively, which are adapted to be received into openings 122, 124 in the third and fourth posts 44, 46, respectively. The first sign holder 110 may comprise an upper rail 126 and a lower rail 128 which are adapted to retain and display at least one sign therein and is preferably dual-sided, as described in further detail below with reference to FIGS. 5 and 6. The first sign holder 110 may further comprise upper openings 130, 132 which are adapted to receive a second (upper) sign holder 140.

As shown in FIG. 2, the second sign holder 140 may be of a wire or plastic coated wire construction and may comprise an outer frame portion 142 and at least one dual wire sign retaining portion 144, 146 which may be triangular in shape as shown (or any other shape) and which is adapted to retain and display at least one sign therein and is preferably dual-sided, as described in further detail below with reference to FIGS. 5 and 6. The second sign holder 140 may further comprise a mounting portion 148 which may also function as a dual wire sign retaining portion adapted to retain and display at least one sign. The mounting portion 148 may comprise threaded extending members 150, 152 which may extend through the openings 130, 132 in the first sign holder 110 and be removably secured thereto by wing nuts 154, 156 or the like.

Figure 4:
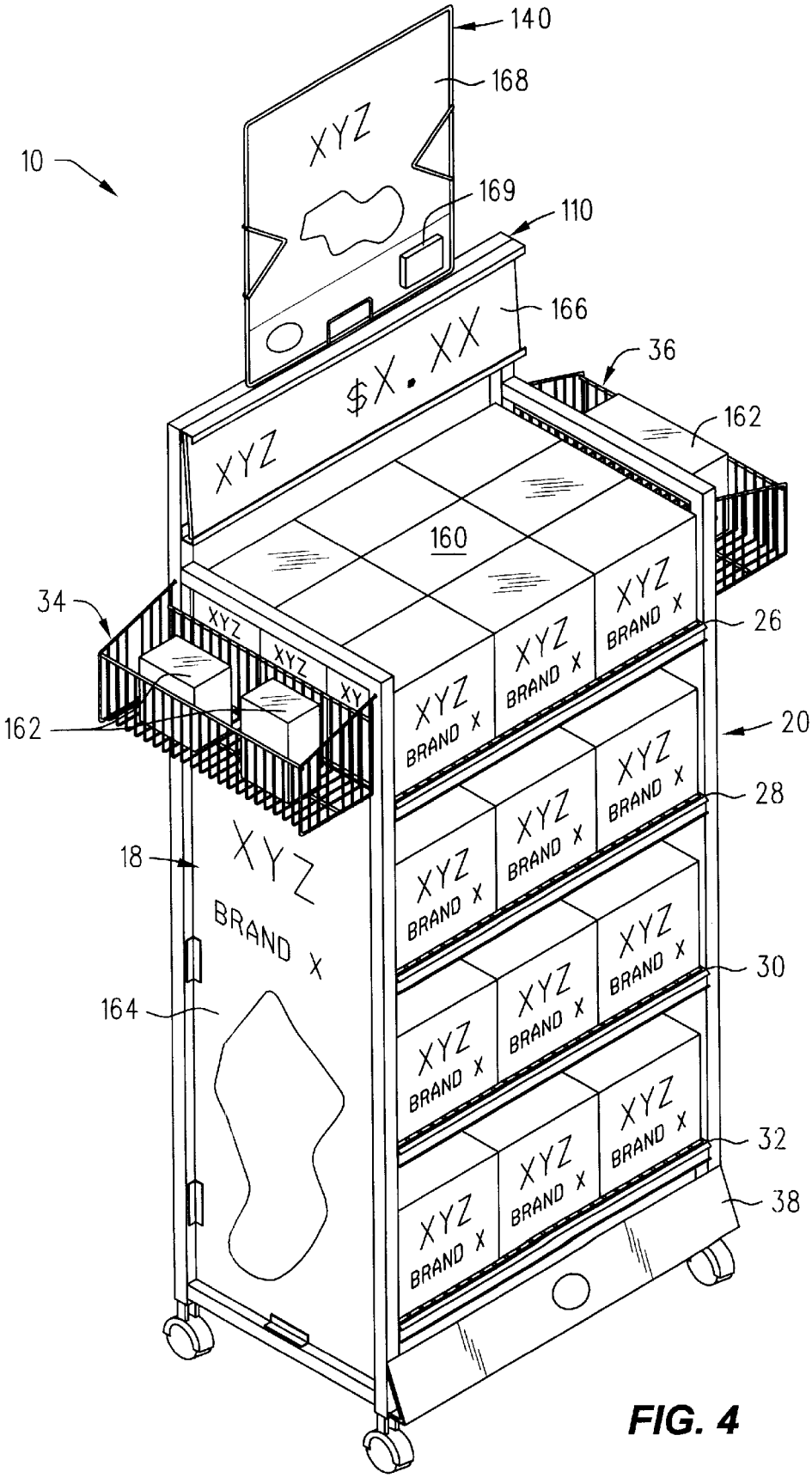
FIG. 4 an isometric view of the display rack of FIGS. 1 and 2 with merchandise and signs thereon.

FIG. 4 illustrates the function of the display rack 10. The primary product 160 to be sold, e.g., a beverage product such as beer, may be displayed on the shelves 26, 28, 30, 32. A cross-merchandising product 162, e.g., a food product such as prepared meals, taco fixings, or chips and dip, may be displayed in the baskets 34, 36 (and baskets 90, 92 in the embodiment of FIG. 3). The sign 164 on the left side 18 of the display rack (and an identical sign—not shown—on the right side 20 of the display rack) may advertise the specific brand of product 160 which is presently on display. As described in further detail below, interchangeable signs advertising alternate brands of product may be retained behind the sign 164 on display, thus the signs are self-storing. The first (upper) sign holder 110 may retain and display a first upper sign 166, which may be a pricing sign that may also include advertising directed to a particular manufacturer but not necessarily to a specific brand of product. The second (upper) sign holder 140 may retain and display a second upper sign 168, which may be an advertising sign that may also be directed to a particular manufacturer but not necessarily to a specific brand of product. As shown in FIG. 4, the second upper sign 168 may also contain pull-off coupons 169 and the like which may relate to either the primary product 160 or the cross-merchandising product 162. To prevent theft of the display rack 10 and/or other manufacturers' products from being displayed thereon, the logo of the manufacturer of the primary product 160 may be included on the kick-plate 38.

Figure 5:
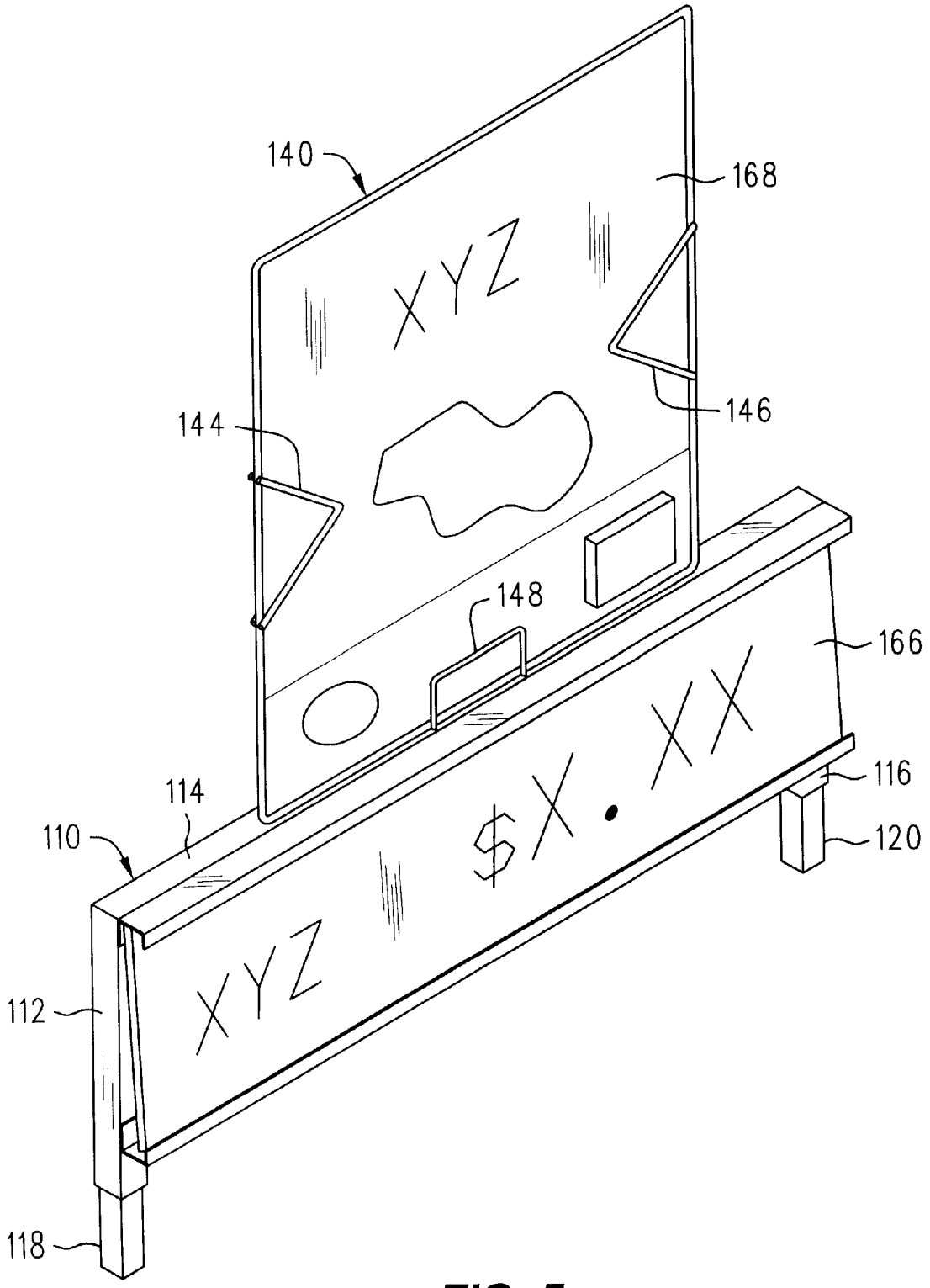
FIG. 5 is an isometric view detailing the uppermost sign holders of the display rack of FIG 4.
Figure 6:
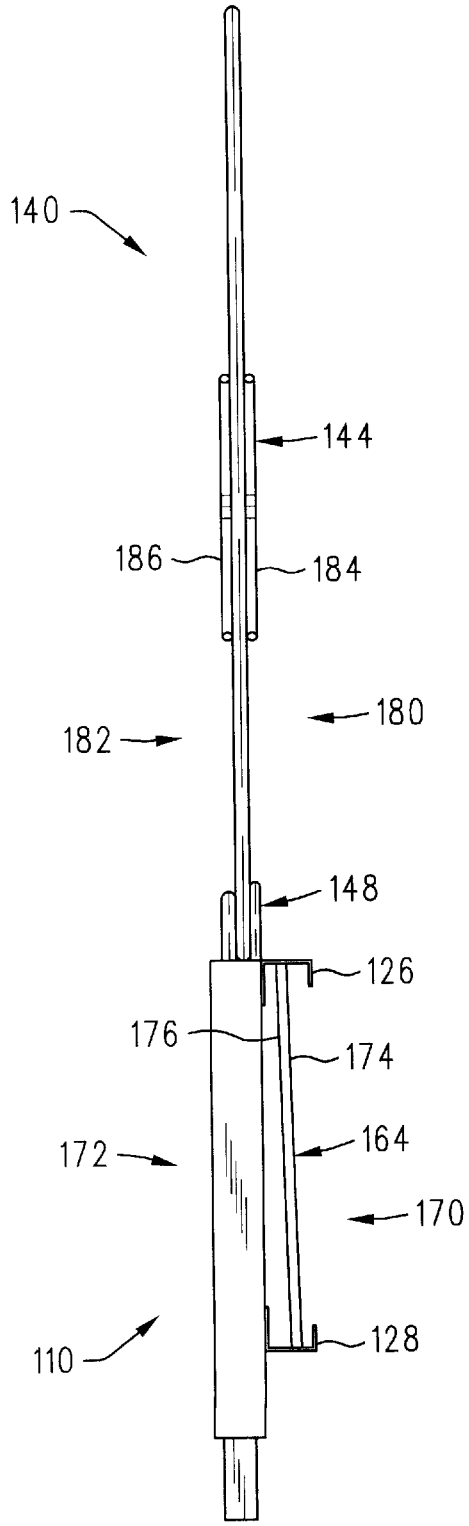
FIG. 6 is a left side elevation view of the uppermost sign holders of FIG. 5.

FIGS. 5 and 6 illustrate the two uppermost sign holders 110, 140 and signs 166, 168 in more detail. As noted above, each of these sign holders 110, 140 may be adapted to retain and display at least one sign 166, 168, respectively. Each of the sign holders 110, 140, may easily be adapted to retain more than one sign. However, in a preferred embodiment, each holder 110, 140 is dual-sided. Specifically, as shown in FIG. 6, the first sign holder 110 comprises a front side 170 and a rear side 172 which may each be substantially open so as to display both the front side 174 and the rear side 176 of the first upper sign 166. Likewise, the second sign holder 140 comprises a front side 180 and a rear side 182 which may each be substantially open so as to display both the front and rear sides of the second upper sign 168 (FIG. 5). In this manner, both the front 14 and rear 16 of the display rack 10 (FIG. 1) may present advertising to customers.

As noted above, the first sign holder 110 may comprise an upper rail 126 and a lower rail 128 which may be fixedly attached to or integrally formed with the posts 112, 114, 116. Also as noted above, the second sign holder 140 may comprise a plurality of dual wire sign retaining portions 144, 146, 148. As shown in FIG. 6, each of the dual wire sign retaining portions, e.g., 144, may comprise a first wire 184 attached to the front side 180 of the sign holder 140 and a second wire 186 attached to the rear side 182 of the sign holder 140. The wires 184, 186 are sufficiently spaced apart and flexible to removably hold at least one sign 168 (FIG. 5) therein.

Figure 7:
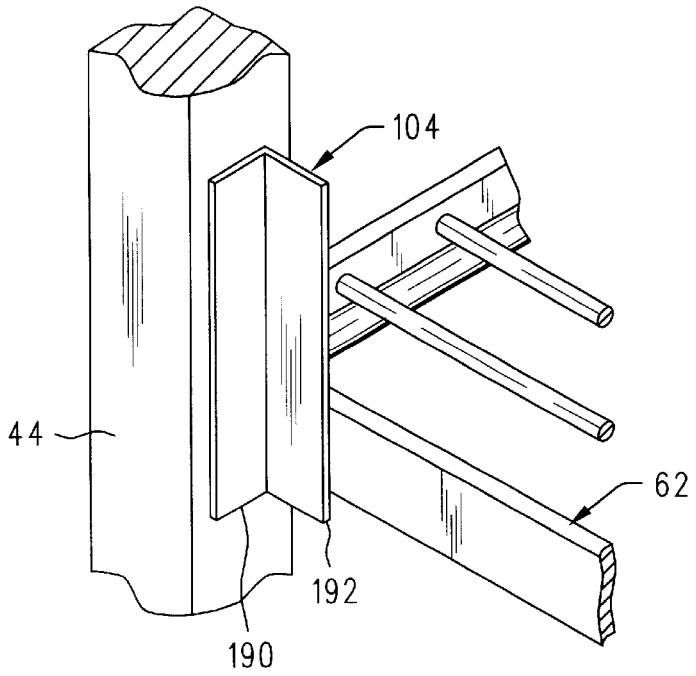
FIG. 7 is an isometric view of a portion of the display rack of FIG. 1 including a sign retainer.
Figure 8:
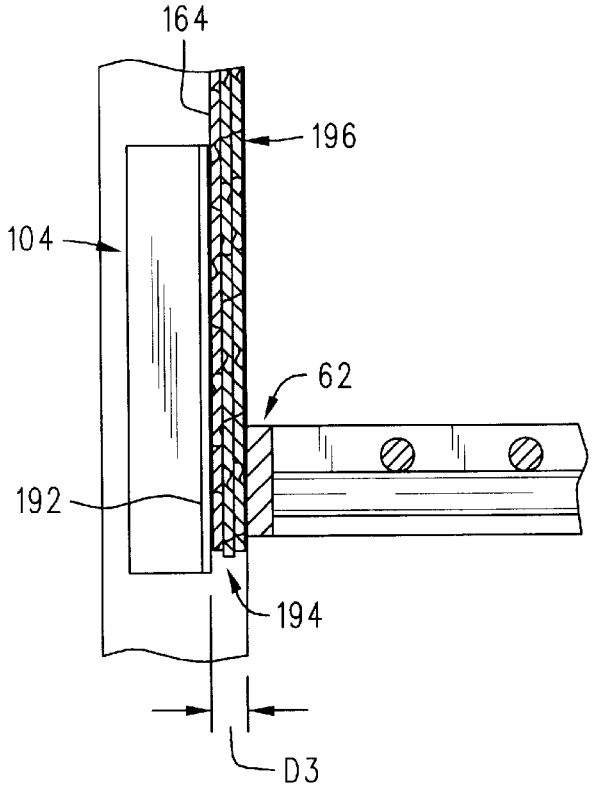
FIG. 8 is a left side elevation view of the portion shown in FIG. 7.

FIGS. 7 and 8 illustrate the function of the sign retaining members 104 on the left and right sides 18, 20 of the display rack 10 (FIG. 1). As shown in FIG. 7, each of the sign retaining members 104 may be substantially L-shaped in cross section and comprise a first portion 190 which may be permanently attached to the post (e.g., 44) and a second portion 192 which extends outwardly from each of the posts (e.g., 44). As shown in FIG. 6, the second portion 192 is preferably spaced apart a distance "D3" from the rim 62 of each shelf, forming a space 194 therebetween. This space 194 is preferably sufficiently wide to store three or more interchangeable signs 196 therein, with the outermost sign 164 (i.e., the sign closest to the sign retainer 104) being presently displayed. The signs 196 preferably advertise alternate brands of the manufacturer's product.

Figure 9:
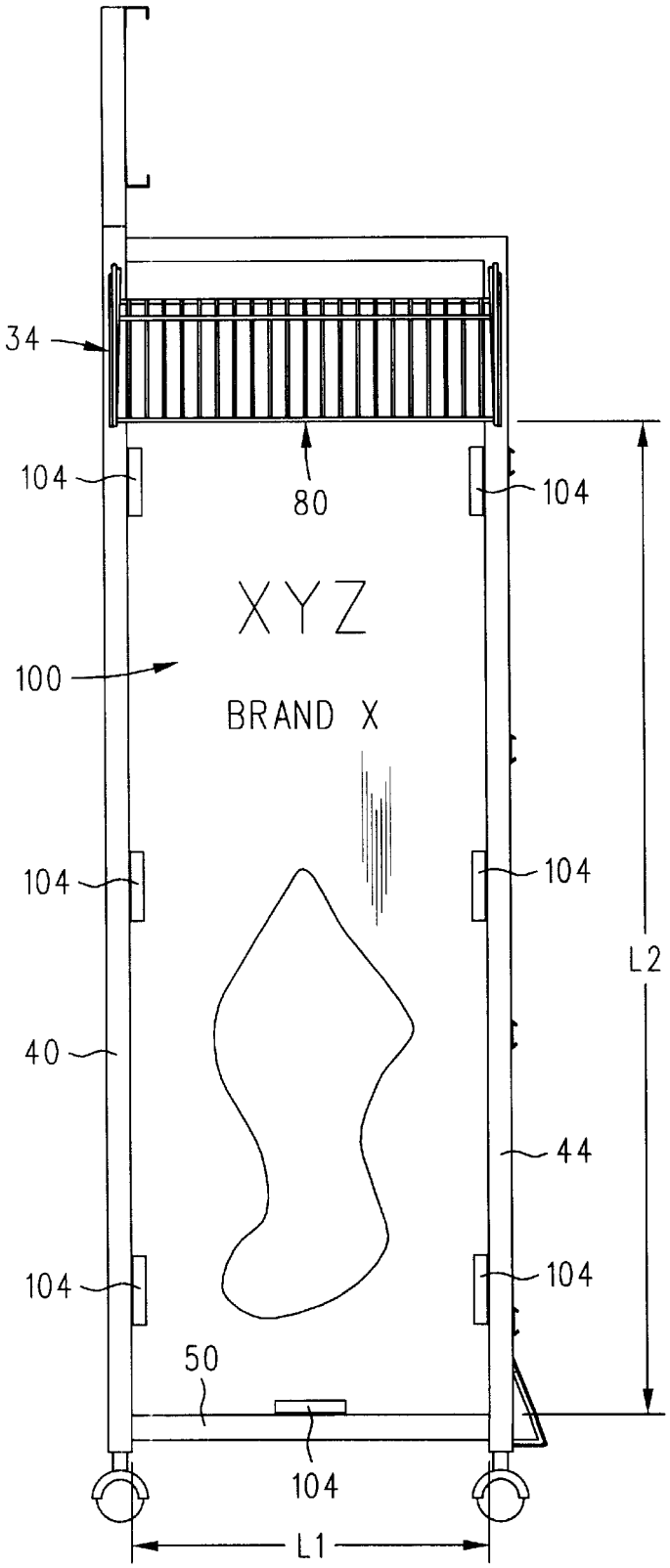
FIG. 9 is a left side elevation view of the display rack of FIG. 1.

FIG. 9 is a left side view of the display rack 10 of FIG. 1 showing the left side display area 100. The right side display area 102 (FIG. 1) may be substantially identical to the left side display area 100 described below so that customers may shop both sides 18, 20 (FIG. 1) of the display. As shown in FIG. 9, the left side display area 100 may extend horizontally a length "L1" from the first post 40 to the third post 44 and vertically a length "L2" from the bottom side 80 of the basket 34 (or the bottom side of the basket 90 in the FIG. 3 embodiment) to the sixth post 50. The sign 164 may extend substantially the same or slightly less than the horizontal length "L1" (as long as at least a portion of each of the sign retaining members 104 extend partially across the sign 164), and preferably extends the same or slightly less than the vertical length "L2", although the sign 164 may extend much less than "L2" if desired and/or if more than one basket is hung on each side (see FIG. 3).

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

We claim:

1. A portable display rack, comprising:

a) a frame having a front side, a rear side, a left side, a right side, a top side and a bottom side, wherein:

I) said front side of said frame comprises a first post and a second post, said posts being separated from one another by a distance, thereby allowing said front side of said frame to be substantially open;

ii) said rear side of said frame comprises a third post and a fourth post, said posts being separated from one another by a distance;

iii) said left side of said frame comprises said first post, said third post, a fifth post at an upper end thereof, and a sixth post at a lower end thereof;

iv) said right side of said frame comprises said second post, said fourth post, a seventh post at an upper end thereof, and an eighth post at a lower end thereof;

b) a plurality of shelves positioned between said first post and said second post, between said third post and said fourth post, between said fifth post and said sixth post, and between said seventh post and said eighth post;

c) at least one basket removably attached to said frame at each of said left side and said right side, said basket comprising a front side, a rear side, a left side, a right side, a top side and a bottom side, wherein said top side is substantially open;

d) a left side display area extending substantially from said bottom side of said basket on said left side to said sixth post and from said first post to said third post;

e) a right side display area extending substantially from said bottom side of said basket on said right side to said eighth post and from said second post to said fourth post;

f) wherein each of said left side display area and said right side display area is adapted to retain a plurality of signs and is also adapted to display a sign therein; and g) a first sign holder removably attached to said third post and said fourth post, said first sign holder adapted to display a sign therein.

2. The portable display rack of claim 1 further comprising a second sign holder removably attached to said first sign holder, said second sign holder being adapted to display a sign therein.

3. The portable display rack of claim 2, wherein each of said first sign holder and said second sign holder comprise a substantially open front side and a substantially open rear side.

4. The portable display rack of claim 2, said second sign holder being of wire construction and comprising an outer frame portion, at least one dual wire sign retaining portion, and a mounting portion removably attached to said first sign holder, said dual wire sign retaining portion adapted to retain a sign.

5. The portable display rack of claim 2 further comprising a second upper sign in said second upper sign holder.

6. The portable display rack of claim 1 further comprising a plurality of sign retaining members, wherein each of said sign retaining members is substantially L-shaped in cross-section and comprises a first portion which is attached to one of said posts and a second portion which extends outwardly from said one of said posts, each of said sign retaining members being spaced apart a sufficient distance from said shelves such that a plurality of signs may be retained between said sign retaining members and said shelves.

7. The portable display rack of claim 1 wherein said frame is of tubular steel construction.

8. The portable display rack of claim 1 wherein each of said shelves is of wire construction.

9. The portable display rack of claim 1, each of said shelves having a front end portion and further comprising a shelf strip extending along said front end portion which is adapted to retain at least one elongate sign strip.

10. The portable display rack of claim 1, wherein each of said baskets is of wire construction.

11. The portable display rack of claim 1 further comprising a plurality of lockable casters extending from said frame.

12. The portable display rack of claim 1 further comprising a kickplate extending from said first post to said second post.

13. The portable display rack of claim 1 further comprising:

a) a first plurality of signs stored in said right side display area, one of said first plurality of signs being displayed in said right side display area;

b) a second plurality of signs stored in said left side display area, one of said second plurality of signs being displayed in said left side display area; and c) a first upper sign in said first sign holder.

14. A portable display rack, comprising:

a) a frame having a front side, a rear side, a left side, a right side, a top side and a bottom side, wherein:

I) said front side of said frame comprises a first post and a second post, said posts being separated from one another by a distance, thereby allowing said front side of said frame to be substantially open;

ii) said rear side of said frame comprises a third post and a fourth post, said posts being separated from one another by a distance;

iii) said left side of said frame comprises said first post, said third post, a fifth post at an upper end thereof, and a sixth post at a lower end thereof;

iv) said right side of said frame comprises said second post, said fourth post, a seventh post at an upper end thereof, and an eight post at a lower end thereof;

b) a plurality of shelves positioned between said first post and said second post and between said third post and said fourth post;

c) at least one basket removably attached to said frame at each of said left side and said right side, said basket comprising a front side, a rear side, a left side, a right side, a top side and a bottom side, wherein said top side is substantially open;

d) a left side area extending substantially from said bottom side of said basket on said left side to said sixth post and from said first post to said third post;

e) a right side display area extending substantially from said bottom side of said basket on said right side to said eighth post and from said second post to said fourth post;

f) wherein each of said left side display area and said right side display area is adapted to retain a plurality of signs and is also adapted to display a sign therein;

g) a first sign holder removably attached to said third post and said fourth post, said first sign holder adapted to display a sign therein; and h) wherein said first sign holder comprises a first sign holder post, a second sign holder post, and a third sign holder post, said first sign holder post and said second sign holder post each comprising an extending portion which is adapted to be received into openings in said third post and said fourth post of said frame, said first sign holder further comprising an upper rail and a lower rail adapted to retain a sign therebetween.

15. A portable display rack, comprising:

a) a frame comprising a first post, a second post, a third post, a fourth post, a fifth post, a sixth post, a seventh post, and an eighth post, said frame having a left side and a right side;

b) a plurality of shelves adapted to display a primary product, said plurality of shelves being positioned between said first post and said second post, between said third post and said fourth post, between said fifth post and said sixth post, and between said seventh post and said eighth post;

c) at least one basket removably attached to said frame at each of said left side and said right side, said at least one basket adapted to display a nonprimary product;

d) a left side display area extending substantially from said basket on said left side to said sixth post and from said first post to said third post;

e) a right side display area extending substantially from said basket on said right side to said eighth post and from said second post to said fourth post;

f) wherein each of said left side display area and said right side display area is adapted to retain a plurality of signs and is also adapted to display a sign therein;

g) a first sign holder removably attached to said third post and said fourth post, said first sign holder adapted to display a sign therein, said first sign holder comprising a substantially open front side and a substantially open rear side; and h) a second sign holder removably attached to said first sign holder, said second sign holder being adapted to display a sign therein, said second sign holder comprising a substantially open front side and a substantially open rear side.

16. The portable display rack of claim 15, said second sign holder being of wire construction and comprising an outer frame portion, at least one dual wire sign retaining portion, and a mounting portion removably attached to said first sign holder, said dual wire sign retaining portion adapted to retain a sign.

17. The portable display rack of claim 15 further comprising a plurality of sign retaining members, wherein each of said sign retaining members is substantially L-shaped in cross-section and comprises a first portion which is attached to one of said posts and a second portion which extends outwardly from said one of said posts, each of said sign retaining members being spaced apart a sufficient distance from said shelves such that a plurality of signs may be retained between said sign retaining members and said shelves.

18. The portable display rack of claim 15, each of said shelves having a front end portion and further comprising a shelf strip extending along said front end portion which is adapted to retain at least one elongate sign strip.

19. The portable display rack of claim 15 further comprising a plurality of lockable casters extending from said frame.

20. The portable display rack of claim 15 further comprising a kickplate extending from said first post to said second post.

21. The portable display rack of claim 15 further comprising:

a) a first plurality of signs stored in said right side display area, each of said signs advertising a specific brand of said primary product, one of said first plurality of signs being displayed in said right side display area;

b) a second plurality of signs stored in said left side display area, each of said signs advertising a specific brand of said primary product, one of said second plurality of signs being displayed in said left side display area;

c) a first upper sign in said first sign holder; and d) a second upper sign in said second sign holder.

22. A portable display rack, comprising:

a) a frame comprising a first post, a second post, a third post, a fourth post, a fifth post, a sixth post, a seventh post, and an eighth post, said frame having a left side and a right side;

b) a plurality of shelves adapted to display a primary product;

c) at least one basket removably attached to said frame at each of said left side and said right side, said at least one basket adapted to display a nonprimary product;

d) a left side display area extending substantially from said basket on said left side to said sixth post and from said first post to said third post;

e) a right side display area extending substantially from said basket on said right side to said eighth post and from said second post to said fourth post;

f) wherein each of said left side display area and said right side display area is adapted to retain a plurality of signs and is also adapted to display a sign therein;

g) a first sign holder removably attached to said third post and said fourth post, said first sign holder adapted to display a sign therein, said first sign holder comprising a substantially open front side and a substantially open rear side;

h) a second sign holder removably attached to said first sign holder, said second sign holder being adapted to display a sign therein, said second sign holder comprising a substantially open front side and a substantially open rear side; and i) wherein said first sign holder comprises a first sign holder post, a second sign holder post, and a third sign holder post, said first sign holder post and said second sign holder post each comprising an extending portion which is adapted to be received into openings in said third post and said fourth post of said frame, said first sign holder further comprising an upper rail and a lower rail adapted to retain a sign therebetween.

* * * * *